US010132566B2

(12) United States Patent
Lee

(10) Patent No.: US 10,132,566 B2
(45) Date of Patent: Nov. 20, 2018

(54) ROOF FOR ELECTRIC FURNACE

(71) Applicant: Hyundai Steel Company, Incheon (KR)

(72) Inventor: Sang-Hoon Lee, Gyeongbuk (KR)

(73) Assignee: Hyundai Steel Company, Incheon (KR)

( * ) Notice: Subject to any disclaimer, the term of this patent is extended or adjusted under 35 U.S.C. 154(b) by 879 days.

(21) Appl. No.: 14/040,369

(22) Filed: Sep. 27, 2013

(65) Prior Publication Data

US 2014/0029643 A1 Jan. 30, 2014

Related U.S. Application Data

(63) Continuation of application No. PCT/KR2011/010138, filed on Dec. 27, 2011.

(30) Foreign Application Priority Data

Mar. 30, 2011 (KR) ..... 10-2011-0028501
Apr. 28, 2011 (KR) ..... 10-2011-0040074
Nov. 24, 2011 (KR) ..... 10-2011-0123634

(51) Int. Cl.
*F27B 14/12* (2006.01)
*F27B 3/08* (2006.01)
(Continued)

(52) U.S. Cl.
CPC ..... *F27B 14/12* (2013.01); *F27B 3/085* (2013.01); *F27B 3/16* (2013.01); *F27D 1/025* (2013.01); *F27D 1/12* (2013.01); *F27D 1/1816* (2013.01)

(58) Field of Classification Search
CPC . B60Q 1/14; C21C 7/10; F21S 48/145; F27D 17/003; F27D 1/1808; F27D 1/1816; F27B 14/12
(Continued)

(56) References Cited

U.S. PATENT DOCUMENTS 3,053,237 A 9/1962 Carter
3,555,163 A * 1/1971 Lucas ..... F27D 17/003 373/9
(Continued)

FOREIGN PATENT DOCUMENTS

EP 0171905 A1 2/1986
EP 1845325 A1 10/2007
(Continued)

*Primary Examiner* — Tu B Hoang
*Assistant Examiner* — Diallo I Duniver
(74) *Attorney, Agent, or Firm* — Mintz Levin Cohn Ferris Glovsky and Popeo, P.C.; Kongsik Kim; Jhongwoo Jay Peck

(57) ABSTRACT

Disclosed herein is a roof for an electric furnace. The roof includes: a small-ceiling seating port (120) which has a small-ceiling seating surface (122) and a small-ceiling support surface (124) that extends from the small-ceiling seating surface inwards and downwards; and a large ceiling (130) which has an upper roof panel (132) that radially extends from the small-ceiling seating port at a downward inclination angle, a lower roof panel (134) disposed below the upper roof panel at a position spaced apart from the upper roof panel, and a side roof panel (136) connected to the upper roof panel and the lower roof panel. The upper roof panel is connected to the outer circumferential surface of the small-ceiling seating port, and the lower roof panel is connected to a lower end of the small-ceiling support surface so that the inclination angle of the lower roof panel can be increased.

9 Claims, 5 Drawing Sheets

(51) Int. Cl.

| | |
|---|---|
| ***F27B 3/16*** | (2006.01) |
| ***F27D 1/02*** | (2006.01) |
| ***F27D 1/12*** | (2006.01) |
| ***F27D 1/18*** | (2006.01) |

(58) Field of Classification Search
USPC ..... 373/8, 9, 138, 71–74, 60, 94, 95, 100; 362/507
See application file for complete search history.

(56) References Cited

U.S. PATENT DOCUMENTS 3,756,172 A * 9/1973 Brereton ..... F27D 1/1816 110/335
3,967,048 A * 6/1976 Longenecker ..... F27B 3/12 110/331
4,021,603 A * 5/1977 Nanjyo ..... F27D 1/1816 373/74
4,182,610 A * 1/1980 Mizuno ..... F27D 9/00 373/74
4,273,949 A * 6/1981 Fischer ..... F27D 1/1816 373/74
4,633,480 A * 12/1986 Bleimann ..... F27B 3/16 373/74
4,644,558 A * 2/1987 Kerr ..... F27B 3/16 373/74
4,715,042 A * 12/1987 Heggart ..... F28F 3/12 373/74
5,115,184 A 5/1992 Arthur et al.
5,290,016 A * 3/1994 Elsner ..... F27D 9/00 266/190
5,444,734 A * 8/1995 Arthur ..... F27D 1/1816 110/331
5,887,017 A * 3/1999 Arthur ..... F27D 1/1816 373/73
2004/0240510 A1 * 12/2004 Lyons ..... F27B 3/085 373/71

FOREIGN PATENT DOCUMENTS

| | | | | |
|---|---|---|---|---|
| EP | 1881285 | A1 | 1/2008 | |
| JP | 1985-013014 | A | 6/1983 | |
| JP | 61-133791 | | 8/1986 | |
| JP | 2001-194070 | A | 7/2001 | |
| KR | 20-181923 | | 5/2000 | |
| KR | 10-2009-0016991 | A | 2/2009 | |
| KR | 10-1026515 | B1 | 3/2011 | |
| WO | 98-43030 | A1 | 10/1998 | |
| WO | WO 2008009468 | A1 * | 1/2008 | ..... F27B 3/16 |

* cited by examiner

ROOF FOR ELECTRIC FURNACE

CROSS-REFERENCE TO RELATED APPLICATIONS

The present application is a continuation application of International Application No. PCT/KR2011/010138 filed on Dec. 27, 2011, which claims priority to Korean Application Nos. KR 10-2011-0028501 filed on Mar. 30, 2011, KR 10-2011-0040074 filed on Apr. 28, 2011, and KR 10-2011-0123634 filed on Nov. 24, 2011, which applications are incorporated herein by reference.

TECHNICAL FIELD

The present invention relates, in general, to roofs for electric furnaces which open or close the electric furnaces and, more particularly, to a roof for an electric furnace which is configured such that the lifetime thereof can be extended and the safety and convenience of a worker can be provided when conducting the work of repairing the roof.

BACKGROUND ART

Generally, electric furnaces are devices which manufacture steel in such a way that raw materials such as iron ore are melted and refined by arc heat generated between a plurality of electrode rods and scrap when current is applied to the electrode rods.

In such an electric furnace, the roof which covers the electric furnace is opened, and raw material such as scrap is put into the electric furnace by a crane or the like. Thereafter, high voltage is applied to the electrode rods that are vertically connected to the roof after the roof covers the upper end of the electric furnace. Then, the raw material is melted by high-temperature arc heat. Molten steel which is formed by melting the raw material such as scrap iron is transferred into a teeming ladle through an outlet hole formed in a lower portion of the electric furnace. The teeming ladle filled with molten steel is transferred to a place for another process by a transport carrier.

The above-mentioned roof effectively blocks and discharges a large amount of fumes which are generated in the electric furnace during the process of melting scrap or the like that has been put into the electric furnace. Also, the roof prevents noise from occurring during the melting process and blocks splash slag from scattering out of the electric furnace.

An example of the prior art was proposed in Korean Utility Model Publication No. 1983-0003259 (Publication date: Dec. 12, 1983, title: Arc type electric furnace ceiling having extended lifetime).

SUMMARY

Accordingly, the present invention has been made keeping in mind the above problems occurring in the prior art, and an object of the present invention is to provide a roof for electric furnaces in which an inclination angle of a lower roof panel is increased, and ceramic heat resistant paint is applied to the lower roof panel, whereby the junction between the lower roof panel and a small-ceiling seating port can be prevented from being damaged by heat, and the lower roof panel can be protected from spark, thus improving the lifetime of the roof.

Another object of the present invention is to provide a roof for electric furnaces which is provided with a safety structure to provide the safety of a worker when repairing the roof, thus preventing the worker from falling from the roof because of accidents during the work of repairing the roof.

A further object of the present invention is to provide a roof for electric furnaces in which an anti-dust unit is installed on a lift structure that is provided on the upper roof panel and is connected to a lift cylinder when the roof is lifted, whereby the separate work of removing dust, which has accumulated in the lift structure, before the roof lifting process is not required.

The objects of the present invention are not limited to the above objects. In order to accomplish the above objects, the present invention provides a roof for an electric furnace, including: a small-ceiling seating port having a small-ceiling seating surface provided horizontally and having an annular shape, and a small-ceiling support surface extending from an inner circumferential edge of the small-ceiling seating surface inwards and downwards in such a way that a diameter of the small-ceiling support surface is reduced from a top thereof to a bottom; and a large ceiling comprising an upper roof panel disposed enclosing the small-ceiling seating port and radially extending from the small-ceiling seating port at a downward inclination angle, a lower roof panel disposed below the upper roof panel at a position spaced apart from the upper roof panel by a predetermined distance, and a side roof panel connected both to an extension edge of the upper roof panel and to an extension edge of the lower roof panel in such a way that the side roof panel encloses the extension edges of the upper and lower roof panels, wherein the upper roof panel is connected to an outer circumferential surface of the small-ceiling seating port, and the lower roof panel is connected to a lower end of the small-ceiling support surface so that the inclination angle of the lower roof panel can be increased.

Furthermore, a plurality of slag catchers may be provided on the lower roof panel, and a coating layer and a heat resistance layer may be successively formed on the lower roof panel having the slag catchers.

In addition, a cooling passage may be provided among the side roof panel, the lower roof panel and the upper roof panel, and a plurality of injection pipes may be radially arranged in the cooling passage and connected to each other, the injection pipes discharging cooling fluid into the cooling passage. At least one of the injection pipes may be connected to a cooling fluid supply pipe through side roof panel, the cooling fluid supply pipe supplying cooling fluid into the cooling passage, and cooling fluid injected into the cooling passage may be discharged out of the cooling passage through a cooling fluid discharge pipe provided on the side roof panel.

Inspection holes may be formed in the upper roof panel at positions corresponding to the respective injection pipes, and inspection hole covers may cover the respective inspection holes, each of the inspection hole covers being rotatably connected to the upper roof panel by a hinge.

The large ceiling may further include a safety structure. The safety structure may include: a plurality of support rods arranged along a perimeter of the upper roof panel; and a banister having a pair of vertical legs respectively fitted into one of the support rods and another adjacent support rod, and a horizontal beam connecting upper ends of the vertical legs to each other.

In detail, a cooling pipe may be coupled to the support rods to cool heat transferred from the electric furnace, the cooling pipe being disposed in such a way as to horizontally connect one of the support rods to another adjacent support rod, and a cooling water supply pipe for supplying cooling water into the cooling pipe and a cooling water discharge pipe for discharging the cooling water from the cooling pipe may be connected to the cooling pipe.

The large ceiling may further include a lift structure. The lift structure may include a pair of horizontal support arms horizontally extending from a portion the upper roof panel that is adjacent to the small-ceiling seating port towards a perimeter of the upper roof panel; a pair of vertical support arms provided on the perimeter of the upper roof panel, the vertical support arms supporting the horizontal support arms; a connection block coupled to outer surfaces of the vertical support arms so that when the roof is lifted, the connection block being connected to a lift cylinder disposed outside the roof; and an anti-dust unit preventing dust from entering the lift structure.

The anti-dust unit may include: a blocking panel provided on outer side surfaces of the horizontal support arms and the vertical support arms; and a blocking cover disposed on upper surfaces of the horizontal support arms, wherein the blocking cover is rotatably coupled to either of the horizontal support arms by a hinge and blocks a space between the horizontal support arms.

A roof for electric furnaces according to the present invention has the following effects. First, an inclination angle of a lower roof panel is increased so that the height of the ceiling can be increased. Thereby, a large amount of scrap iron can be put into the electric furnace.

Furthermore, because the distance between a heat source and the junction between the lower roof panel and a small-ceiling seating port is increased, the junction can be prevented from being damaged by heat. As a result, it is expected that the lifetime of the roof can be extended.

Second, a small-ceiling support surface of the small-ceiling seating port is on the same level, and the lower roof panel is connected to the small-ceiling support surface. Therefore, repair work for the junction between the small-ceiling support surface and the lower roof panel can be facilitated, and the repair period can be reduced.

Third, ceramic heat resistant paint is applied to the lower roof panel so that the lower roof panel can be protected from spark, thus increasing the lifetime of the roof.

Fourth, a safety structure, which includes support rods and a banister removably fitted to the support rods, is provided on an upper roof panel, thus preventing accidents such as a worker falling from the roof when repairing the roof. Also, the safety structure can provide a sense of safety to the worker who is doing work on the roof.

Fifth, the roof is provided with an anti-dust unit which covers an upper portion and both side surfaces of the lift structure, thus preventing dust or the like from entering the lift structure and accumulating therein. Therefore, the present invention can avoid a problem in which the worker must remove dust that has accumulated in the lift structure so as to balance the center of gravity of the roof when lifting the roof.

DETAILED DESCRIPTION

Figure 1:
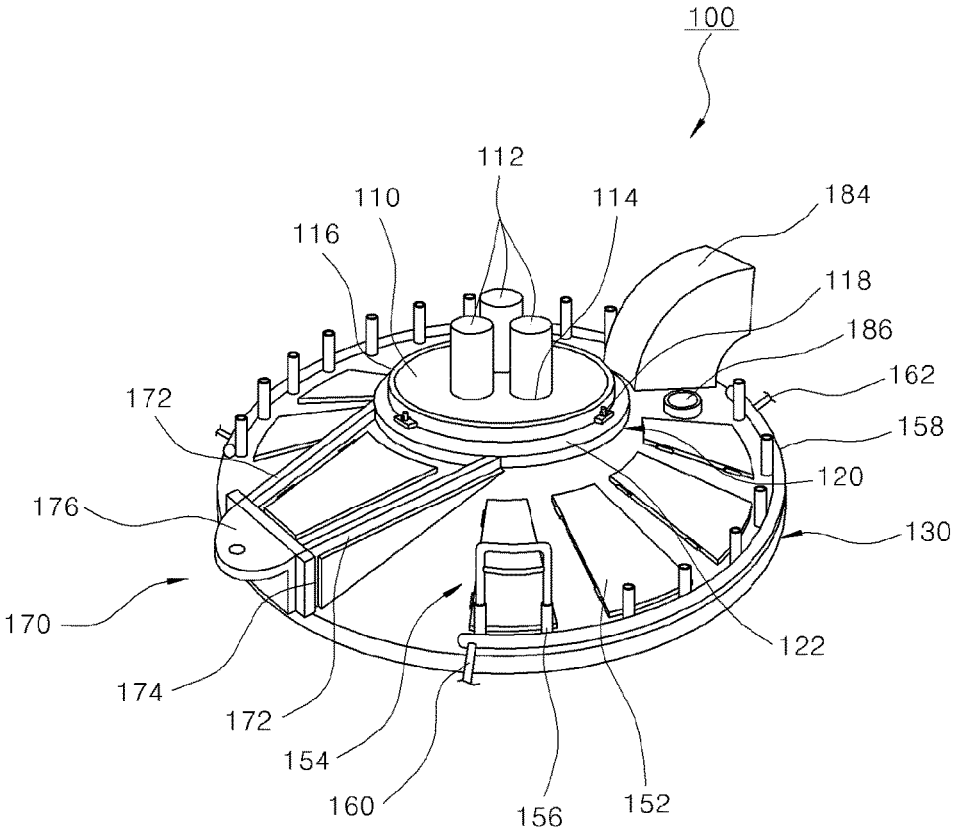
FIG. 1 is a perspective view illustrating a roof for an electric furnace, according to the present invention.

Hereinafter, the present invention will be described with reference to the attached drawings. Reference should now be made to the drawings, in which the same reference numerals are used throughout the different drawings to designate the same or similar components. If detailed descriptions of well-known functions or configurations would unnecessarily obfuscate the gist of the present invention, the detailed descriptions will be omitted.

FIG. 1 is a perspective view illustrating a roof for an electric furnace, according to the present invention. The electric furnace roof 100 includes a small-ceiling seating port 120 into which a small ceiling 110 is seated, and a large ceiling 130 which encloses the small ceiling 110.

The small ceiling 110 is formed of castable refractories or concrete. Three electrode holes 114 into which respective electrode rods 112 are inserted are formed in the small ceiling 110. The electrode rods 112 are coupled to an electrode arm (not shown) which is provided above the small ceiling 110 so that vertical movement of the electrode rods 112 can be automatically adjusted while the electric furnace is operated, whereby an arc distance between lower ends of the electrode rods 112 and an upper surface of molten filling can be maintained constant.

Figure 2:
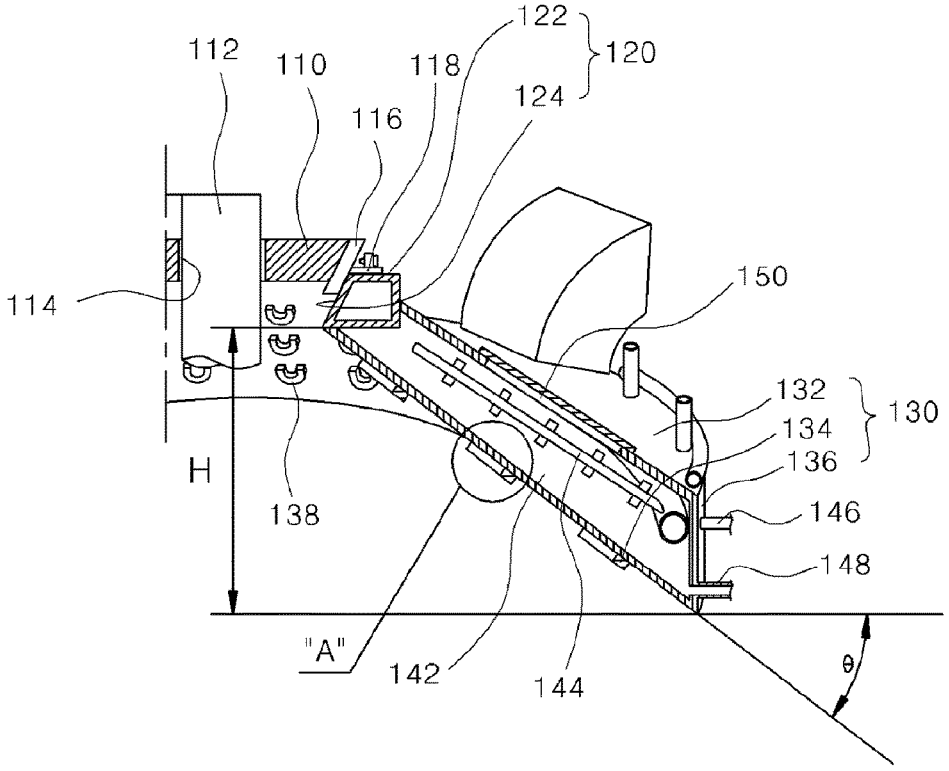
FIG. 2 is a partially sectional perspective view of the electric furnace roof of FIG. 1 according to the present invention.
Figure 3:
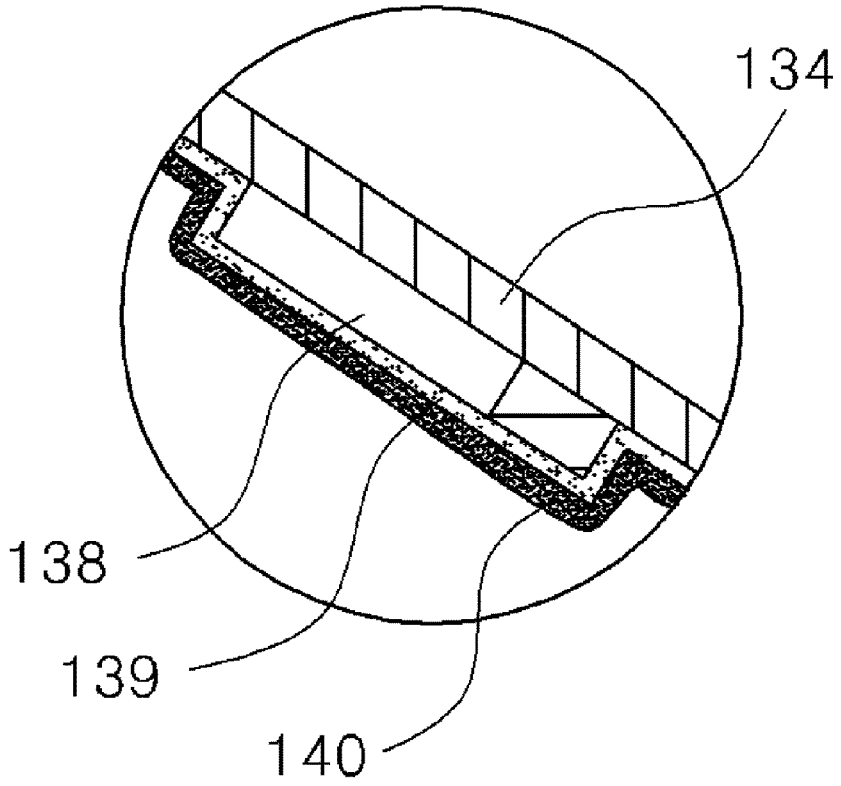
FIG. 3 is an enlarged view of portion "A" of FIG. 2.

The small-ceiling seating port 120 into which the small ceiling 110 is seated has an annular shape and is oriented horizontally. As shown in FIG. 2, a small-ceiling seating surface 122 is formed on an upper end of the small-ceiling seating port 120. A small-ceiling support surface 124 is formed in an inner circumferential surface of the small-ceiling seating port 120. The small-ceiling support surface 124 is formed in such a way that the diameter thereof is reduced from the top of the inner circumferential surface of the small-ceiling seating port 120 to the bottom thereof. A shell 116 which is provided enclosing an outer circumferential surface of small ceiling 110 is brought into close contact with the small-ceiling support surface 124. Stop protrusions 118 are provided on the shell 116 and are placed on the small-ceiling seating surface 122.

The large ceiling 130 includes an upper roof panel 132, a lower roof panel 134 which is spaced apart from the upper roof panel 132, and a side roof panel 136 which is connected both to an extension edge of the upper roof panel 132 and to an extension edge of the lower roof panel 134 in such a way that the side roof panel 136 encloses the extension edges of the upper and lower roof panels 132 and 134. The upper roof panel 132 radially extends outwards from an outer circumferential surface of the small-ceiling seating port 120 at a downward inclination angle. In a similar manner, the lower roof panel 134 radially extends outwards from a lower end of the small-ceiling support surface 124 at a downward inclination angle. Because the lower roof panel 134 is directly connected to the lower end of the small-ceiling support surface 124, an angle θ between the lower roof panel 134 and the bottom of the large ceiling 130 is increased. As a result, a height H of the top of the large ceiling 130 is increased. The angle θ ranges from 19° to 25° and, preferably, it ranges from 20.1° to 20.5°. Slag catchers 138 are provided on a surface of the lower roof panel 134 that faces molten metal. A coating layer 139 and a heat resistance layer 140 are successively formed on the lower roof panel 134 on which the slag catchers 138 are provided. The slag catchers 138, the coating layer 139 and the heat resistance layer 140 prevent the lower roof panel 134 from being damaged by heat transferred from the molten metal.

As shown in the drawings, each slag catcher 138 is an approximately "U" shaped to catch slag and prevent the caught slag from easily flowing downwards. The coating layer 139 is formed of at least one selected from among Al, Ni, Cr, an Al alloy, a Ni alloy, a Cr alloy and an ultra heat resistant alloy by spray coating. The heat resistance layer 140 is formed of ceramic that is a heat resistant material applied by either spray coating or enamel coating.

Meanwhile, a cooling passage 142 is formed in the large ceiling 130, that is, in the side roof panel 136, the lower roof panel 134 and the upper roof panel 132, to cool heat transferred from the electric furnace. A plurality of injection pipes 144 which discharge cooling fluid are arranged in the cooling passage 142. The injection pipes 144 of the cooling passage 142 are connected to each other and are radially arranged in the cooling passage 142. At least one of the injection pipes 144 is connected to a cooling fluid supply pipe 146 through which cooling fluid is supplied from the outside into the cooling passage 142. Cooling fluid that has been injected into the cooling passage 142 is discharged out of the cooling passage 142 through a cooling fluid discharge pipe 148. The cooling fluid supply pipe 146 is connected to the injection pipes 144 through the side roof panel 136, and the cooling fluid discharge pipe 148 is preferably provided on the side roof panel 136. As shown in FIG. 2, inspection holes 150 are formed in the upper roof panel 132 at positions corresponding to the respective injection pipes 144. The inspection holes 150 are covered with respective inspection hole covers 152. Each inspection hole cover 152 is rotatably connected to the upper roof panel 132 by a hinge.

A safety structure 154 and a lift structure 170 are further provided on the large ceiling 130. Also, a dust collection elbow 184 and an auxiliary raw material inlet 186 are provided on the large ceiling 130.

Figure 4:
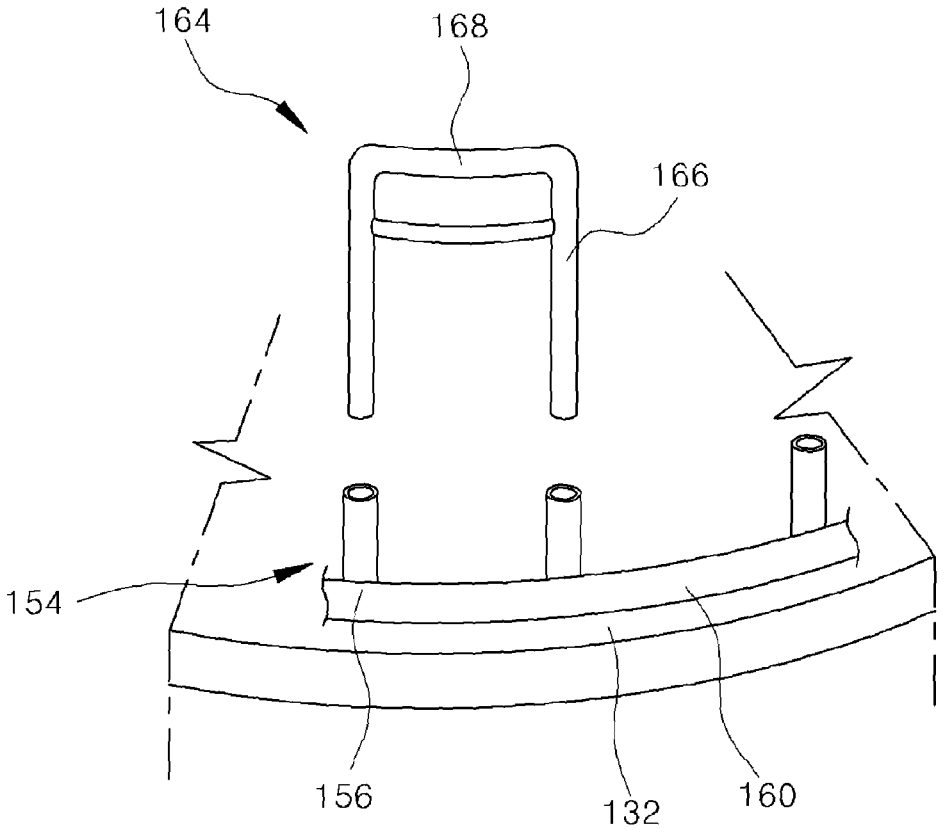
FIG. 4 is a perspective view illustrating the coupling of a safety structure shown in FIG. 1 to the electric furnace roof.

The safety structure 154 is provided on the large ceiling 130 to secure the safety of a worker when conducting the work of repairing the roof 100. As shown in FIG. 4, the safety structure 154 includes a plurality of support rods 156, each of which has a vertical cylindrical shape, and a banister 164 which is selectively fitted into the support rods 156.

The support rods 156 are vertically provided on the perimeter of the upper roof panel 132 at positions spaced apart from each other at regular intervals. A cooling pipe 158 is coupled to the support rods 156 to cool heat transferred from the electric furnace. The cooling pipe 158 is disposed in such a way that it horizontally connects one support rod 156 to another adjacent support rod 156. Another cooling water supply pipe 160 is connected to the cooling pipe 158 to supply cooling water from the outside thereto. Another cooling water discharge pipe 162 is connected to the cooling pipe 158 to discharge cooling water out of the cooling pipe 158. The banister 164 is selectively fitted into the support rods 156 to which the cooling pipe 158 is coupled.

The banister 164 includes a pair of vertical legs 166 which are respectively fitted into one support rod 156 and another adjacent support rod 156, and at least one horizontal beam 168 which connects upper ends of the vertical legs 166 to each other. Only when the work of repairing the roof 100 is conducted is the banister 164 inserted into two selected support rods 156 by the worker. In other words, the worker installs the banister 164 on the corresponding support rods 156 adjacent to a task location so as to protect himself/herself from danger, e.g., falling from the roof 100. The lift structure 170 is provided on the large ceiling 130 to make it possible to lift the roof 100. When it is required to lift the roof 100, a lift cylinder (not shown) which is disposed outside the roof 100 is connected to the lift structure 170. The lift structure 170 is installed on the roof 100 with a balanced center of gravity such that the roof 100 is not tilted to one side.

Figure 5:
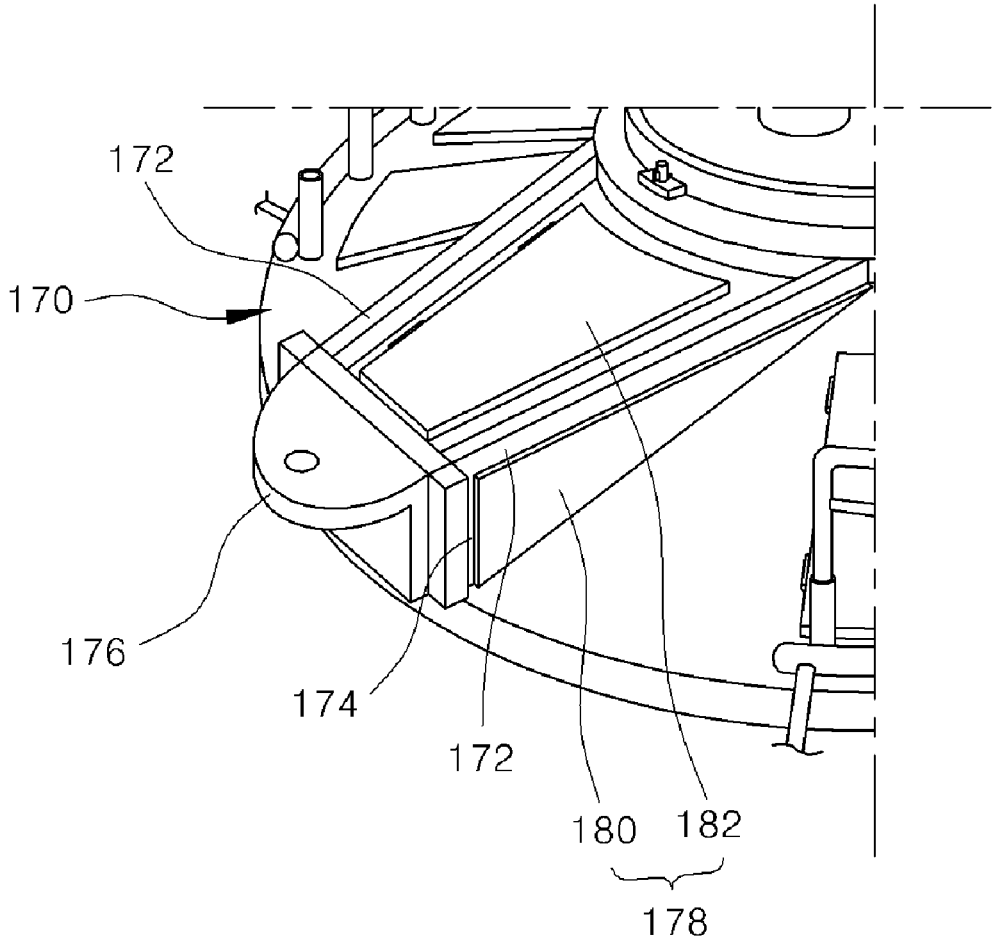
FIG. 5 is an enlarged perspective view of a lift structure shown in FIG. 1.

As shown in FIG. 5, the lift structure 170 includes a horizontal support arm 172 and a vertical support arm 174. The horizontal support arm 172 comprises a pair of horizontal support arms 172. The horizontal support arms 172 horizontally extend from a portion the upper roof panel 132 that is adjacent to the small-ceiling seating port 120 towards the perimeter of the upper roof panel 132. The vertical support arm 174 comprises a pair of vertical support arms 174 which are provided on the perimeter of the upper roof panel 132. The vertical support arms 174 are connected to the horizontal support arms 172 that extend towards the perimeter of the upper roof panel 132, thus supporting the horizontal support arms 172. A connection block 176 is coupled to outer surfaces of the vertical support arms 174 so that the lift cylinder is connected to the connection block 176 when lifting the roof 100.

The lift structure 170 includes an anti-dust unit 178. The anti-dust unit 178 functions to prevent dust from entering the lift structure 170 and accumulating therein and includes blocking panels 180 which block both sides of the lift structure 170, and a blocking cover 182 which blocks an upper portion of the lift structure 170. As shown in the drawing, each blocking panel 180 is fixed to the outer surfaces of one of the horizontal support arms 172 and the corresponding adjacent vertical support arm 174 to prevent dust from entering the lift structure through space between the horizontal support arm 172 and the vertical support aim 174. The blocking cover 182 is disposed on the upper surfaces of the horizontal support arms 172 to prevent dust from entering the lift structure through space between the horizontal support arms 172. The blocking cover 182 that blocks the space between the horizontal support arms 172 is rotatably connected to either of the horizontal support arms 172 by a hinge.

In the electric furnace roof 100 according to the present invention having the above-mentioned construction, the inclination angle of the lower roof panel 134 of the large ceiling 130 is increased so that the height of the ceiling can be increased. Thereby, a large amount of scrap iron can be put into the electric furnace. Furthermore, because the distance between a heat source and the junction between the lower roof panel 134 and the small-ceiling seating port 120 is increased, the junction can be prevented from being damaged by heat. The slag catchers 138 are attached to the lower roof panel 134 and ceramic heat resistant paint 140 is applied thereto, whereby the lower roof panel 134 can be protected from sparks.

Further, in the electric furnace roof 100 according to the present invention, the safety structure 154, which includes the support rods 156 and the banister 164 removably fitted into the support rods 156, is provided on the upper roof panel 132, thus preventing accidents such as a worker falling from the roof 100 when conducting the work of repairing the roof 100. Also, the safety structure 154 can provide a sense of safety to the worker who is doing work on the roof 100.

Moreover, the electric furnace roof 100 according to the present invention includes the anti-dust unit 178 which covers the upper portion and both side surfaces of the lift structure 170, thus preventing dust or the like from entering the lift structure 170 and accumulating therein. Therefore, the present invention can avoid a problem in which the worker must remove dust that has accumulated in the lift structure 170 so as to balance the center of gravity of the roof 100 when lifting the roof 100.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

DESCRIPTION OF THE ELEMENTS IN THE DRAWINGS

| | |
|---|---|
| 100: roof for electric furnace | 110: small ceiling |
| 120: small-ceiling seating port | |
| 122: small-ceiling seating surface | |
| 124: small-ceiling support surface | |
| 130: large ceiling | |
| 132: upper roof panel | 134: lower roof panel |
| 136: side roof panel | 142: cooling passage |
| 144: injection pipe | 150: inspection hole |
| 152: inspection hole cover | 154: safety structure |
| 156: support rod | 158: cooling pipe |
| 164: banister | 170: lift structure |
| 178: anti-dust unit | 180: blocking panel |
| 182: blocking cover | |

The invention claimed is:

1. A roof for an electric furnace, comprising:

a center-ceiling having electrode holes through which electrode rods are inserted;

a seating port of annular shape that has a center-ceiling seating surface disposed horizontally and a center-ceiling support surface that extends from an inner circumferential edge of the center-ceiling seating surface at an inclined angle in an inward direction and in a downward direction reducing a diameter of the center-ceiling support surface from a top thereof to a bottom; and an outer-ceiling, wherein the outer-ceiling surrounding the center-ceiling further comprises:

an upper roof panel coupled to an outer circumferential surface having a vertical arrangement of the seating port and radially extends from the seating port at a downward inclination angle;

a lower roof panel disposed below the upper roof panel at a position spaced apart from the upper roof panel by a predetermined distance;

a side roof panel connected to an extension edge of the upper roof panel and to an extension edge of the lower roof panel to enclose the extension edges of the upper and lower roof panels;

a cooling passageway provided within a cavity defined by the side roof panel, the lower roof panel and the upper roof panel;

a plurality of injection pipes radially arranged within the cooling passageway and connected to each other, wherein the injection pipes discharge cooling fluid into the cooling passageway;

a plurality of support rods arranged along a perimeter of the upper roof panel; and a banister having an inverted-U shape that includes a pair of vertical legs and a horizontal beam that connects upper ends of the vertical legs, wherein lower ends of the vertical legs are configured to be removably inserted into the support rods, wherein the lower roof panel is connected to a lower end of the center ceiling support surface to increase the inclination angle of the lower roof panel, wherein a shell that encloses an outer circumferential surface of the center-ceiling contacts the center-ceiling support surface, and a stop protrusion is disposed on the shell and on top of the center-ceiling seating surface, and wherein a highest point of the injection pipes are disposed below a bottom surface of the center-ceiling.

2. The roof for an electric furnace according to claim 1, further comprising:

a plurality of slag catchers disposed on the lower roof panel; and a coating layer and a heat resistance layer successively formed on the lower roof panel that has the plurality of slag catchers.

3. The roof for an electric furnace according to claim 2, wherein the coating layer is formed of at least one selected from a group consisting of: Aluminum (Al), Nickel (Ni), Chromium (Cr), an Al alloy, a Ni alloy, a Cr alloy and an ultra-heat resistant alloy by spray coating.

4. The roof for an electric furnace according to claim 2, wherein the heat resistance layer is formed of ceramic that is a heat resistant material by either spray coating or enamel coating.

5. The roof for an electric furnace according to claim 1, wherein at least one of the injection pipes is connected to a cooling fluid supply pipe via the side roof panel, the cooling fluid supply pipe supplies cooling fluid into the cooling passageway, and cooling fluid injected into the cooling passageway is discharged out of the cooling passageway via a cooling fluid discharge pipe disposed on the side roof panel.

6. The roof for an electric furnace according to claim 1, further comprising:

a plurality of inspection apertures formed in the upper roof panel at positions that correspond to the respective injection pipes; and a plurality of inspection aperture covers that cover the respective inspection apertures, wherein each of the inspection aperture covers are rotatably connected to the upper roof panel by a hinge.

7. The roof for an electric furnace according to claim 1, further comprising:

a cooling pipe coupled to the support rods to cool heat transferred from the electric furnace, wherein the cooling pipe being horizontally connects one of the support rods to another adjacent support rod, and a cooling water supply pipe that supplies cooling water into the cooling pipe and a cooling water discharge pipe that discharges the cooling water from the cooling pipe are connected to the cooling pipe.

8. The roof for an electric furnace according to claim 1, wherein the outer-ceiling further comprises a lift structure, the lift structure including:

a pair of horizontal support arms that extend horizontally from a portion of the upper roof panel adjacent to the seating port towards a perimeter of the upper roof panel;

a pair of vertical support arms disposed on the perimeter of the upper roof panel, wherein the vertical support arms support the horizontal support arms;

a connection block coupled to outer surfaces of the vertical support arms to connect the connection block to a lift cylinder disposed extraneous to the roof when the roof is lifted; and an anti-dust unit that prevents dust from entering the lift structure.

9. The roof for an electric furnace according to claim 8, wherein the anti-dust unit includes:

a blocking panel disposed on outer side surfaces of the horizontal support arms and the vertical support arms; and a blocking cover disposed on upper surfaces of the horizontal support arms, wherein the blocking cover is rotatably coupled to either of the horizontal support arms by a hinge and blocks a space between the horizontal support arms.

* * * * *